United States Patent [19]

Kobayashi et al.

[11] 4,271,808

[45] Jun. 9, 1981

[54] FUEL INJECTION PUMP FOR INTERNAL COMBUSTION ENGINES

[75] Inventors: Masayoshi Kobayashi; Toru Sakuranaka; Keiichi Yamada, all of Higashi-Matsuyama, Japan

[73] Assignee: Diesel Kiki Co., Ltd., Tokyo, Japan

[21] Appl. No.: 1,285

[22] Filed: Jan. 4, 1979

[30] Foreign Application Priority Data

Jan. 20, 1978 [JP] Japan ..... 53-4240
Feb. 3, 1978 [JP] Japan ..... 53-10563

[51] Int. Cl.[3] ..... F02M 37/04

[52] U.S. Cl. ..... 123/506; 123/449; 417/304

[58] Field of Search ..... 123/139 ST, 139 BD, 123/139 AF, 139 AE, 140 FG, 506, 449, 503; 417/304, 288, 289

[56] References Cited

U.S. PATENT DOCUMENTS

| | | | |
|---|---|---|---|
| 2,810,376 | 10/1957 | Aldinger | 123/139 BD |
| 3,339,534 | 9/1967 | Eheim et al. | 123/140 FG |
| 3,620,648 | 11/1971 | Hofer et al. | 123/139 BD |
| 3,848,576 | 11/1974 | Hofer | 123/139 BD |
| 4,073,275 | 2/1978 | Hofer et al. | 123/139 BD |
| 4,164,921 | 8/1979 | Hofer et al. | 123/139 ST |

*Primary Examiner*—Ira S. Lazarus
*Assistant Examiner*—Magdalen Moy
*Attorney, Agent, or Firm*—Frishauf, Holtz, Goodman & Woodward

[57] ABSTRACT

A fuel injection pump in which a relief channel is formed which communicates with the pump working chamber and is arranged to be blocked by a valve means, associated with a valve actuating means responsive to a pressure varying with engine r.p.m., during starting of the engine so that the fuel injection quantity is increased. Thus, improved starting characteristics of the engine can be obtained. Said relief channel may comprise a first channel communicating with the pump working chamber, and a second relief channel which has a portion thereof extending in the pump plunger to terminate in an outer periphery of the bottom end of said plunger and is so disposed as to communicate with the pump suction chamber after a predetermined delivery stroke length or prestroke has been executed. Communication between said first and second relief channels is adapted to be interrupted by said valve means at less than a predetermined engine r.p.m. As another advantageous arrangement, the relief channel may comprise a first relief channel which includes a port having one end communicating with the pump working chamber and the other end terminating in an outer periphery of the plunger and a communication channel having one end terminating in an inner periphery of the plunger barrel and the other end arranged for communication with a lower pressure zone, and a second relief channel allowing a restricted flow rate and communicating with the pump working chamber. The port and communication channel of said first relief channel are so disposed as to communicate with each other at the beginning of the delivery stroke of the plunger. Said first and second relief channels are arranged to be simultaneously blocked by said valve means during starting of the engine.

9 Claims, 4 Drawing Figures

FUEL INJECTION PUMP FOR INTERNAL COMBUSTION ENGINES

FIELD OF THE INVENTION

The present relates to a fuel injection pump for use with an internal combustion engine, and more particularly to an improved distributor type fuel injection pump which can contribute to improvement in the starting characteristics of the engine.

In a fuel-injection type internal combustion engine including the Diesel engine, it is necessary to control the fuel injection quantity in dependency on the operating conditions such as load or engine r.p.m. To improve the starting characteristics of the engine, usually the fuel injection quantity is so regulated as to be larger when starting the engine than in the ordinary or higher speed operation of the engine.

In a known distributor type fuel injection pump, the fuel injection quantity is regulated by displacing the fuel quantity setting sleeve slidably fitted on the pump plunger arranged for pumping motion within the pump housing, by means of the centrifugal governor which is arranged for actuation in response to engine r.p.m. Thus, the position of the plunger can be varied at which the cut-off port leading to the fuel feeding channel axially extending in the plunger becomes disengaged from said fuel quantity setting sleeve, which determines the fuel injection end. Said centrifugal governor is so arranged that a shifter being displaced by the flyweights opening or closing in response to pump r.p.m. causes the starting lever and the tension lever, both arranged for pivoting about a common fixed fulcrum, to be pivoted about said fulcrum against the force of the starting spring and the governor spring as the shifter is displaced, which in turn displaces said fuel quantity setting sleeve which is connected to the common end of the levers.

However, according to such fuel injection quantity regulating mechanism, the displacement of the shifter caused by the opening of the flyweights can have a limited stroke due to the spatial and structural limitations. Accordingly, it is difficult to set large the lift of the shifter. Also, there is a corresponding limitation in setting large the stroke through which the starting lever can be pivoted, against the force of the starting spring, from the starting position to the idling position where the starting lever comes into unison with the tension lever. For these reasons, the injection quantity is insufficient during starting of the engine, which exerts an unfavorable influence upon the starting characteristics of the engine.

OBJECTS AND SUMMARY OF THE INVENTION

Therefore, the present invention has been devised in order to overcome mainly the above-mentioned drawback, and it is a primary object of the invention to provide a fuel injection pump for internal combustion engines which can ensure an adequate amount of fuel injection quantity during starting of the engine to improve the starting characteristics of the engine.

It is another object of the invention to provide a fuel injection pump of the above type which can preclude the use of the starting spring and the starting lever, and in which the tension lever is arranged to have a larger pivotal stroke so that the fuel injection quantity is regulated with higher accuracy during the ordinary or higher engine speed operation when the governor is actuated.

It is still another object of the invention to provide a fuel injection pump of the above type which has an increased injection quantity as well as an injection advance during starting of the engine thereby to improve the engine startability, and also has a reduced injection pressure during an idling operation of the engine to obtain a reduced injection rate thereby to suppress the combustion noise.

Said primary object of the invention can be achieved by the arrangement which includes a relief channel having one end thereof communicating with the pump working chamber and the other end arranged for communication with a zone under a lower pressure, a valve means provided across said relief channel, and a valve actuating means communicating with a pressure source supplying a pressure varying with engine r.p.m., wherein said valve means is actuated by said valve actuating means responsive to said varying pressure to block said relief channel during starting of the engine.

A first advantageous embodiment of the invention comprises a first relief channel having one end thereof communicating with the pump working chamber, a second relief channel having a portion thereof extending in the plunger to have one end thereof terminating in an outer periphery of the bottom end of the plunger, said end of said second relief channel being so disposed as to disengage from an end edge of the fuel quantity setting member to communicate with the pump suction chamber after a predetermined delivery stroke length or prestroke has been executed, a valve means provided across said first and second relief channels for controlling communication therebetween, and a valve actuating means communicating with a pressure source supplying a pressure varying with engine r.p.m., wherein said valve means is arranged to be actuated by said valve actuating means responsive to said varying pressure to interrupt communication between said first and second relief channels at less than a predetermined engine r.p.m.

A second advantageous embodiment of the invention comprises a first relief channel including a port having one end thereof communicating with the pump working chamber and the other end terminating in an outer periphery of the plunger and a communication channel having one end thereof terminating in an inner periphery of the plunger barrel and the other end arranged for communication with a zone under a lower pressure, and a second relief channel allowing fuel to flow therethrough at a restricted rate, with one end thereof opening in the pump working chamber and the other end communicating with a zone under a lower pressure, a valve means provided across said first and second relief channels, and a valve actuating means arranged in communication with a pressure source supplying a pressure varying with engine r.p.m., wherein said port and communication channel of the first relief channel are so disposed as to communicate with each other at the beginning of the delivery stroke of the plunger, and said valve means is arranged to be actuated by said valve actuating means responsive to the varying pressure from said pressure source for blocking both said first and second relief channels during starting of the engine, opening both of them in a predetermined low engine speed range, and opening solely said first relief channel in a higher engine speed range.

DETAILED DESCRIPTION OF THE INVENTION

Figure 1:
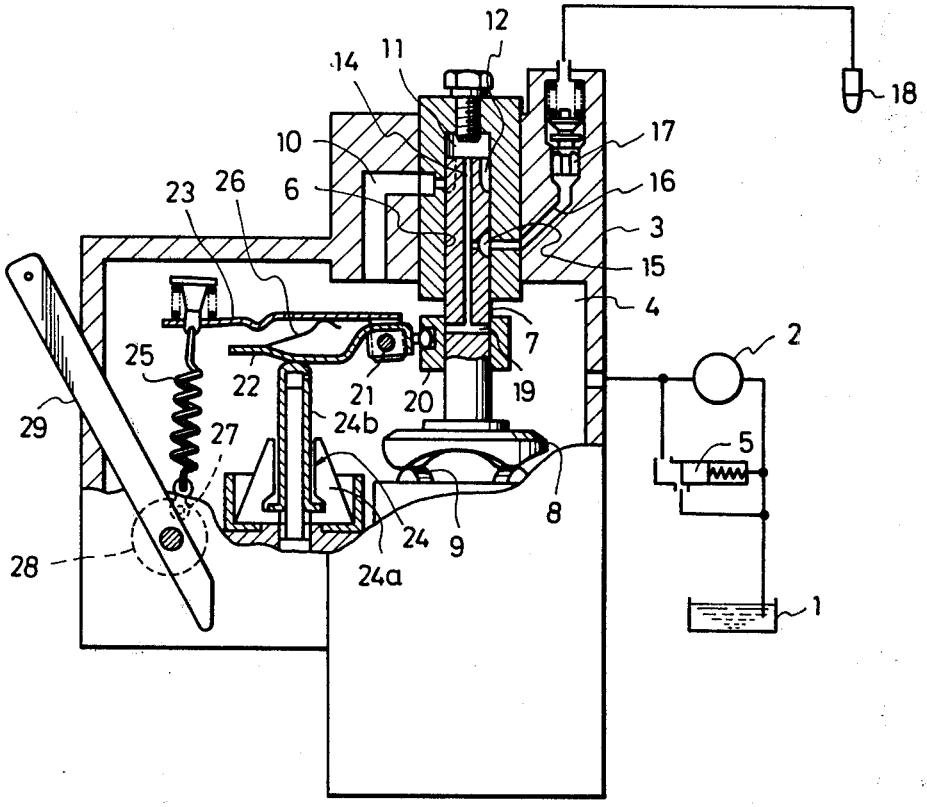
FIG. 1 PRIOR ART
FIG. 1 is a partly longitudinal sectional view of a conventional distributor type fuel injection pump.

FIG. 1 shows a conventional distributor type fuel injection pump, in which fuel is aspirated from a fuel tank 1 by a fuel pump 2 driven by an output shaft of the engine, not shown, and fed under pressure into a suction chamber 4 formed within the housing 3 of the fuel injection pump. In a known manner, a fuel pressure control valve 5 controls the pressure within the suction chamber 4 in dependence on engine r.p.m. so that as the engine r.p.m. increases, so does the fuel pressure in the suction chamber 4 in a predetermined manner.

A plunger 7 is slidably received within a plunger barrel 6 penetrating the pump housing 3, for simultaneous reciprocating and rotating motion to perform the dual function of fuel pumping and distribution, as hereinafter described. More specifically, a cam plate 8 is provided integral with the plunger 7 for rotation through a driving disk, not shown, by means of the drive shaft, not shown, of the fuel injection pump driven by the engine. Said cam plate 8 has a cam surface formed, at equal intervals, with highs corresponding in number to the number of the cylinders of the engine. Said cam plate 8 has its cam surface urged against rollers 9 retained on a roller holder, not shown, by a spring, not shown, so that the cam plate 8 and accordingly the plunger 7 is caused by rotation of said drive shaft to simultaneously rotate and reciprocate.

During the suction stroke when the plunger 7 is moved downwardly in the drawing, said pump working chamber 11 has an increasing volume. At the same time, one longitudinal groove 12 of a plurality of such grooves formed in the peripheral surface of the top end of the plunger 7 faces one end of a supply line 10 formed in the housing 3 with the other end terminating in the suction chamber 4 so that fuel is sucked into the pump working chamber 11.

Now, when the plunger 7 is upwardly moved through the pressure or delivery stroke, the communication between the supply line 10 and the longitudinal grooves 12 is interrupted. Accordingly, the fuel introduced into the working chamber 11 is delivered under pressure through a channel 14, which axially extends through the central portion of the plunger 7, and a longitudinal distributing groove 15, which is formed in the outer periphery of the plunger 7, into outlet pressure lines 16 penetrating the barrel 6 and the pump housing 3. The fuel then passes through delivery valve 17 into injection nozzles 18 by which it is injected into the respective cylinders of the engine. Only one each of the outlet pressure lines 16, delivery valves 17, and injection nozzles 18 is shown for the simplification of illustration. Said outlet pressure lines 16 are the same in number as the number of cylinders in the engine and are arranged circumferentially of the barrel 6 and the housing 3 at equal intervals so that fuel can be injected into each of the cylinders alternately in a predetermined order in accordance with the reciprocating and rotating motion of the plunger 7.

Also formed in a portion of the plunger 7 projecting into the suction chamber 4 is a transverse cut-off port 19 which intersects the channel 14 for communicating said channel 14 with the suction chamber 4. Said cut-off port 19 is adapted to be obturated by the inner peripheral surface of a fuel quantity setting sleeve 20 slidably fitted on said portion of the plunger 7. Thus, when the plunger 7 is upwardly moved to disengage the cut-off port 19 from the upper end edge of the sleeve 20 to cause the port to open into the suction chamber 4, fuel in the channel 14 flows through the cut-off port 19 into the suction chamber 14, and accordingly the delivery of fuel into the outlet pressure lines 16 is interrupted thus to terminate the injection of delivery stroke of the plunger. Said fuel quantity setting sleeve 20 is arranged in engagement with levers 22 and 23 which in turn are arranged for pivotal motion by means of an operating input mechanism for presetting a desired engine speed and a governor mechanism for detecting an actual engine speed (neither of them is shown) so that when the engine speed is desired to be set to a lower value or when the engine is being operated at a higher speed than a preset speed, said sleeve is displaced downward in the drawing to obtain a sooner injection end during the delivery stroke, thus reducing the injection quantity.

Said two levers 22 and 23 are mounted in the housing 3 for pivoting about a common fixed fulcrum 21. Said fuel quantity setting sleeve 20 is engaged by the starting lever 22 which is pivotable by the action of a centrifugal governor 24 having flyweights **24*a*, while said tension lever 23 which is arranged on the pivoting side of the starting lever 22 and tensioned by a governor spring 25 engaged said starting lever 22 via a starting spring 26** having a smaller spring force.

Said governor spring 25 is connected with an end portion of an operating shaft 28 via a connecting pin 27 in eccentricity therewith. Said operating shaft 28 has a portion thereof projecting outside the pump housing 3 on which portion a control lever 29 is mounted. Said control lever 29 is connected with an accelerator pedal, not shown, so that the pretension of the governor spring 25 can be varied in response to the position of the accelerator pedal. Thus, immediately after the engine has been started when the centrifugal governor 24 still remains unactuated, the fuel injection quantity is so regulated that an increased amount of fuel is injected owing to the position of the fuel quantity setting sleeve 20 which is biased in the fuel increasing direction by the starting spring 26. When the engine speed has risen up to a predetermined idling speed, the starting spring 26 becomes contracted so that the starting lever 22 is brought into unison with the tension lever 23 and pivots therewith until the tension of the governor spring 25 predetermined by the position of the control lever 29 comes into equilibrium with the acting force of the centrifugal governor 24. The fuel quantity setting sleeve 20 is thus shifted so that the fuel injection quantity has a suitable value for the load then applied to the engine.

However, as previously noted, such conventional arrangement inherently has a limitation in the lift of the flyweights **24*a* of the centrifugal governor 24 which in turn imposes a limitation upon the amount of displacement of the shifter 24*b* dependent upon the opening and closing motion of the flyweights. Therefore, it is impossible to set sufficiently large the starting stroke which extends from the starting position in which the starting spring 26 begins to be contracted to the idling position in which the starting lever 22 comes into unison with the tension lever 23. Furthermore, as the starting lever 22** moves along said stroke, the fuel injection quantity decreases linearly. For these reasons, a sufficient fuel injection quantity is not obtained in starting, the engine thus providing an inferior engine startability.

Figure 2:
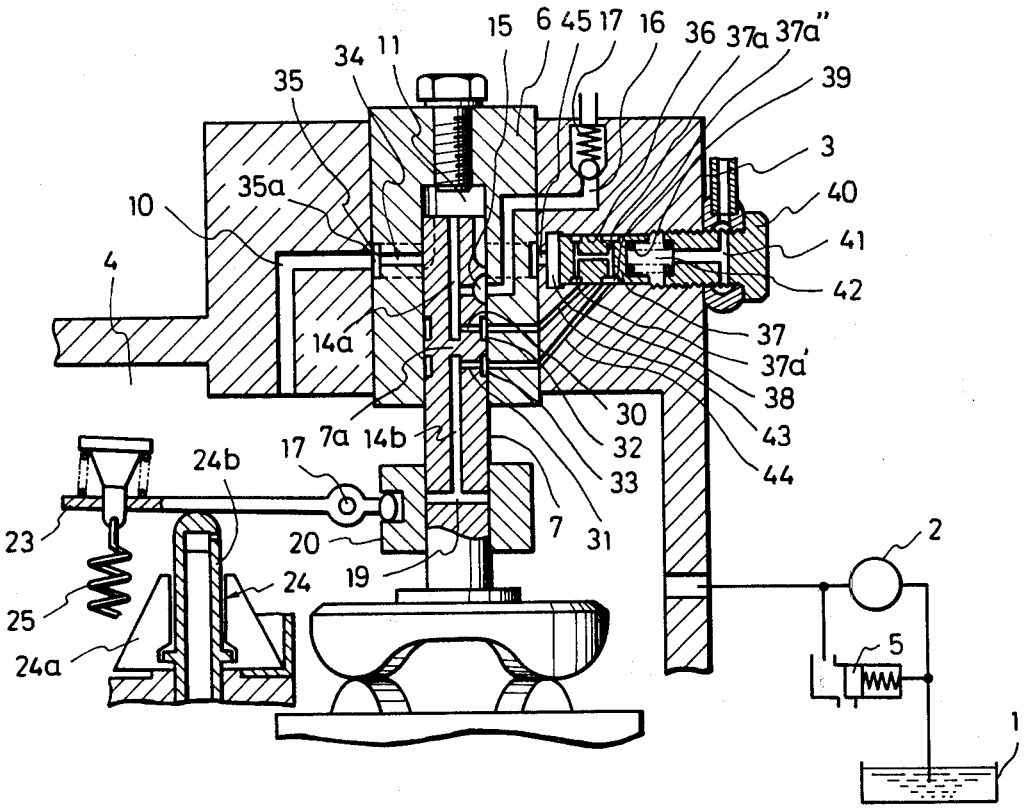
FIG. 2 is a partly longitudinal sectional view of a first embodiment of the distributor type fuel injection pump according to the invention.

The present invention has been devised in order to overcome such defects in the conventional arrangement, and one embodiment thereof will now be described with reference to FIG. 2. In FIG. 2, like reference numerals designate like or corresponding parts or elements to those in FIG. 1. The plunger 7 has its interior formed with a fuel feeding channel 14*a* formed of a blind bore axially extending in a front end portion thereof to terminate in a top end surface thereof to communicate with a pump working chamber 11, and an axial cut-off channel 14*b* formed of another blind bore axially extending in a bottom end portion thereof to interesect a cut-off port 19 radially terminating in an outer periphery of the bottom end of the plunger. The channels 14*a* and 14*b* are separated from each other by means of a central wall portion 7*a* of the plunger 7. They communicate respectively with annular peripheral grooves 32, 33 formed in the outer periphery of the plunger 7 via respective transverse bores 30, 31.

On the other hand, a fuel supply line 10 is formed in a top portion of the pump housing 3. Formed through the lateral wall of the plunger barrel 6 in which the plunger 7 makes a reciprocal sliding motion is a suction bore 34 which communicates at one end thereof with said supply line 10 via an annular groove 35 formed around the outer periphery of the barrel 6 and intersecting said supply line 10. Said suction bore 34 is adapted to communicate at the other end with the pump working chamber 11 defined by the housing 3, the barrel 6 and the plunger 7, during the suction stroke of the plunger 7. Meanwhile, a valve bore 36 is formed in the top portion of the housing 3 which is in communication with said annular groove 35 via a small communication bore 45. A piston or valve body 37 which has its interior formed with a channel 37*a* extending in H-shaped path is slidably received within said valve bore 36, to define a fluid or fuel chamber 38 between a top or left end face of the valve body 37 and said valve bore 36. A spring seat or plug 40 is provided which has been threadedly fitted into an open end of said valve bore 36 after a compression spring 39 was inserted thereinto, and urges an outward or right end of the valve body 37 in an axial direction of the bore 36. Said plug 40 has its interior formed with a relief channel 41 extending in T-shaped path. Also formed between the outward end of the piston valve body 36 and the plug 40 is a chamber 42 with a variable volume which may be supplied with a fluid or fuel pressure from upstream of the fuel pump 2 through said T-shaped channel 41 and also through a spill tube 46 connected thereto, or may be open to the atmosphere through said channel 41 and tube 46. A pair of fuel passages 43, 44 extend from the pair of annular grooves 32, 33 formed in the outer periphery of the plunger 7 through the barrel 6 and the pump housing 3 to connect said annular grooves 32, 33 with said valve bore 36.

When the engine speed has exceeded a predetermined idling speed, an increased fuel pressure within the suction chamber 4 causes a corresponding increase in the fuel pressure within the chamber 38 through the supply line 10 and the annular groove 35, which in turn causes a displacement of the piston valve body 37 to bring an outward end of said valve body 37 into contact with the plug 40. Then, the H-shaped channel 37*a* in the valve body 37 has two ports 37*a'* and 37*a''* thereof register with the respective associated open ends of the fuel passages 43, 44, so that the fuel feeding channel 14*a* in the plunger 7 communicates with the cut-off channel 14*b* through the fuel passages 43, 44 and the H-shaped channel 37*a* within the piston 37. The H-shaped channel 37*a* and the passages 43, 44 are so disposed that when the engine has just been started and the fuel pressure within the chamber 38 has not yet increased with the piston valve body 37 kept off the plug 40, at least one of the passages 43, 44 is obturated by the periphery of the valve body 37 to interrupt the communication between the fuel feeding channel 14*a* and the cut-off channel 14*b*.

On the other hand, the sliding sleeve or shifter 24*b* of the centrifugal governor 24 directly engages a tension lever 23 which in turn is engaged by a governor spring 25, to actuate the fuel quantity setting sleeve 20. Thus, the starting spring and the starting lever as conventionally used can be dispensed with.

With the above arrangement, as aforementioned, in the engine speed range of between the time when the engine was just started and the time when the engine nearly reaches the predetermined idling speed, during which range the engine has an increasing fuel injection quantity, the piston valve body 37 is kept at a distance from the plug 40 to keep interrupted the communication between the fuel feeding channel 14*a* and the cut-off channel 14*b* of the plunger 7. Accordingly, fuel feeding takes place through the fuel feeding channel 14*a*, the outlet pressure lines 16, the delivery valves 17 and the injection nozzles 18 over the entire pressure stroke of the plunger 7 from the top dead point to the bottom dead point irrespective of the position of the fuel quantity setting sleeve 20 then held, to carry out fuel injection in a sufficient amount into the engine cylinders, thus improving the starting characteristics of the engine.

Then, after the engine has reached a predetermined idling speed, the piston valve body 37 is moved rightward against the force of spring 39 into contact with the plug 40 owing to an increased fuel pressure within the fuel chamber 38, to establish a communication between the H-shaped channel 37*a* and the fuel passages 43, 44 and accordingly that between the fuel feeding channel 14*a* and the cut-off channel 14*b* as previously mentioned. As a consequence, fuel is fed to the injection nozzles 18 during the pressure or delivery stroke between the bottom dead point and a position of the plunger 7 at which the open end of the cut-off port 19 disengages from the upper end edge of the fuel quantity setting sleeve 20, in dependency on the position of the sleeve 20 determined by the equilibrium in force between the centrifugal governor 24 and the governor spring 25. Thus, an appropriate fuel injection quantity can be obtained which is in proportion to the load applied to the engine.

As explained above, according to the present embodiment, fuel injection can take place all the time during the entire pressure stroke of the plunger 7 after the engine has started until it reaches a predetermined idling speed, thus enabling to obtain an adequate injection quantity required for starting the engine, thereby to achieve better starting characteristics of the engine.

Also, the present embodiment allows preclusion of the use of the starting lever and the starting spring, which in turn renders unnecessary adjustment of the stroke of the starting lever in assemblage of the fuel injection pump. Furthermore, spacewise and structurally the pivotal stroke of the tension lever which engages the governor spring can be set larger with ease owing to the removal of the starting lever and starting spring, which enables to achieve with a higher accuracy control of the fuel injection quantity during the ordinary or middle or high engine speed operation in which the governor is actuated, and brings about other advantages.

Figure 3:
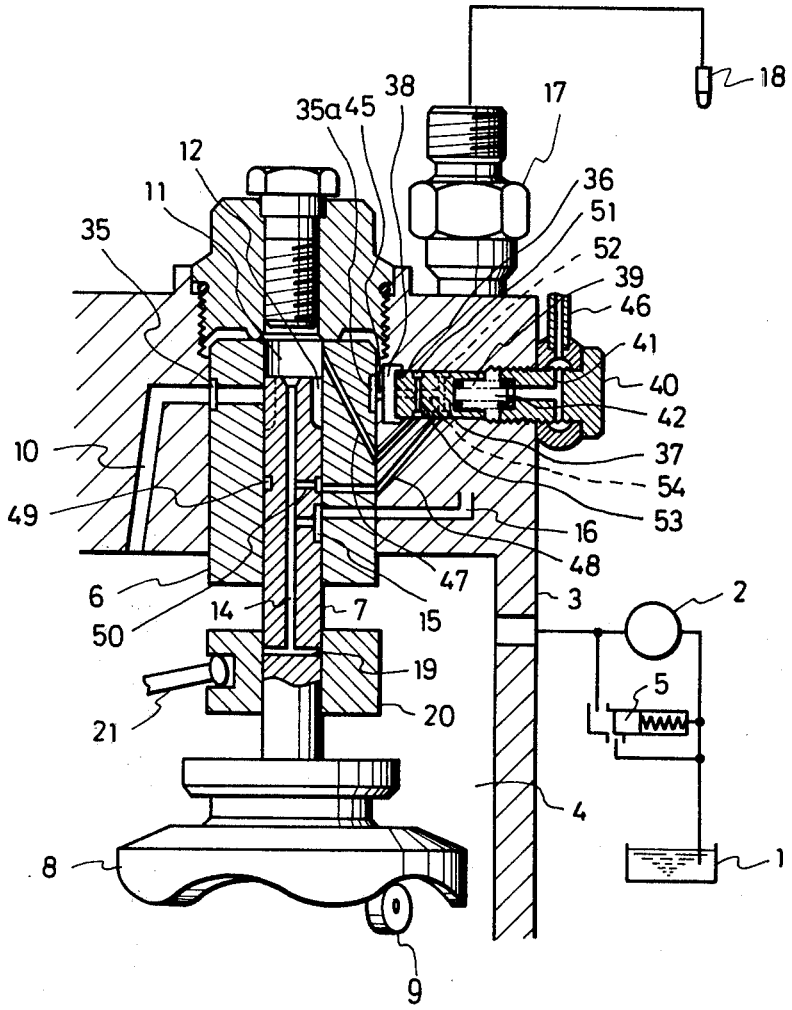
FIG. 3 is a partly longitudinal sectional view of a second embodiment of the distributor type fuel injection pump according to the invention.
Figure 4:
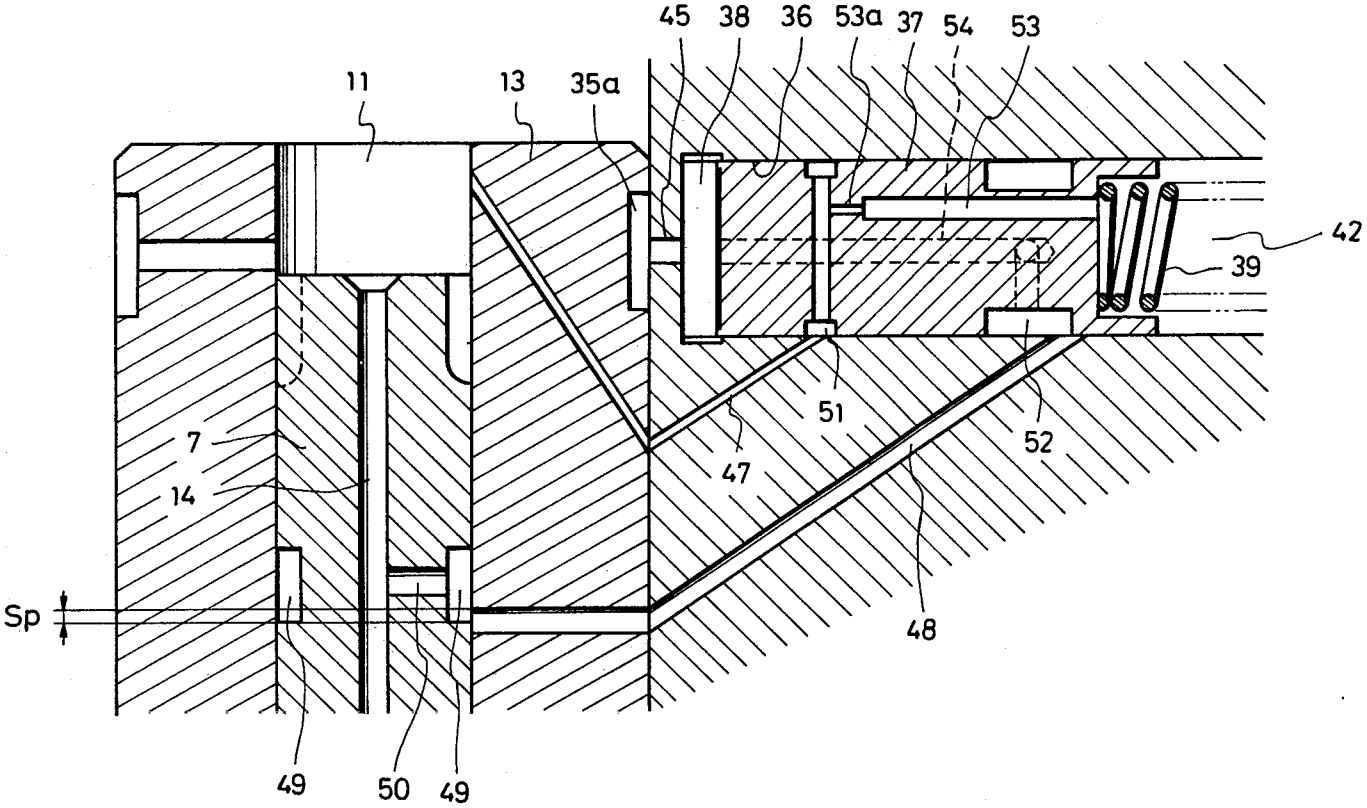
FIG. 4 is a view showing on an enlarged scale an essential part of FIG. 3.

Another embodiment of the invention will now be described with reference to FIGS. 3 and 4. In FIGS. 3 and 4, like reference numerals designate corresponding parts or elements to those in FIGS. 1 and 2.

Since the overall construction according to this second embodiment is generally similar or identical to that of the first embodiment previously described except for the points described hereinbelow, detailed description of the overall construction is omitted.

According to this embodiment, a communication channel 47 extends through the plunger barrel 6 and the housing 3, with one end thereof opening in the pump working chamber 11 and the other end terminating in the inner periphery of the cylinder bore 36. Also formed through the barrel 6 and the housing 3 is a further communication channel 48 which has one end thereof terminating in the inner periphery of the barrel 6 which is in sliding contact with the outer periphery of the plunger 7 and the other end in the inner periphery of the bore 36. An annular groove 49 is also formed in the outer periphery of the plunger 7, which is so disposed as to register with an associated open end of said communication channel 48 when the plunger 7 is at the bottom dead point, i.e., when the longitudinal distributing groove 15 begins to face associated open ends of the outlet pressure lines 16. The annular groove 49 communicates, through a transverse bore 50, with the channel 14 which extends in the plunger 7 from the top end thereof to a point of the bottom end thereof where it intersects the cut-off port 19.

The outer periphery of the piston 37 is formed with two annular grooves 51, 52 which are so disposed as to face associated open ends of said communication channels 47, 48 at a predetermined stroke position of the piston 37, in such a fashion that when the piston 37 is positioned nearer to the plug 40 with respect to said predetermined position, the annular groove 52 with a larger width on the outward end side of the piston 37 still engages with the associated open end of the communication channel 48, whereas the annular groove 51 with a smaller width on the top end side of the piston 37 is out of engagement with the associated open end of the communication channel 47 (refer to FIG. 4).

One groove 51 of the annular grooves 51, 52 communicates with the chamber 42 through a passage 53 which includes a restriction portion 53*a* and extends through the piston 37 radially and axially thereof. Whilst, the other annular groove 52 communicates with the chamber 38 through a passage 54 extending in an L-shaped path through the piston 37.

With this arrangement, during starting of the engine, the pressure under which fuel is fed from the suction chamber 4 to the chamber 38 on the top end side of the piston 37 through the chamber 35*a* is still low and accordingly the piston 37 is biased more leftward than its illustrated position by the force of compression spring 42, so that both the two annular grooves 51, 52 of the piston 37 are kept obturated by the inner periphery of the cylinder bore 36. Therefore, fuel is fed under ordinary or usual pressure to the injection nozzles 18 through the longitudinal distributing groove 15, the outlet pressure lines 16 and the delivery valves 17 to be injected into the combustion chambers of the engine all the time from when the plunger 7 is at the bottom dead point until the cut-off port 19 gets disengaged from the upper edge of the fuel quantity setting sleeve 20.

Next, in the low engine speed range mainly including the idling operation, the fuel feeding pressure increases to some extent such that a correspondingly increased pressure in the chamber 38 forces the piston 37 to rightwardly move from said starting position into the illustrated position, to allow the open ends of the communication channels 47, 48 to register with the annular grooves 51, 52, respectively. Thus, at the beginning of the delivery stroke of the plunger 7 when the plunger 7 is at the bottom dead point, the annular groove 49 engages with the associated open end of the communication channel 48 as previously mentioned, with the result that fuel is discharged from the annular groove 49 into the suction chamber 4 which is under a lower pressure, through a first relief passage formed by the communication channel 48, the annular groove 52 and the passage 54 within the piston 37. Thus, fuel is prevented from being supplied to the injection nozzles 18 which have a larger flow resistance than said first relief passage. Then, upon disengagement of the annular groove 49 from the associated open end of the communication channel 48, the discharge of fuel is interrupted and fuel injection takes place with a time lag by an amount corresponding to the stroke Sp (hereinafter called "prestroke") over which the annular groove 49 and the communication port 48 overlap each other. Simultaneously, part of fuel within the pump working chamber 11 flows at a restricted rate into a lower pressure zone such as the suction side of the fuel pump 2 through a second relief passage consisting of the communication channel 47, the annular groove 51 and the passage 53, thus resulting in a limited increase in the fuel pressure in the pump working chamber 11 which is confined within a certain range. This limited increase in the fuel pressure within the pump working chamber 11 leads to a decrease in the fuel injection quantity per unit time or the fuel injection rate. The decrease in the fuel injection quantity due to the limited fuel pressure automatically causes the governor to act to make longer the injection period so as to compensate for the decrease amount in the fuel injection quantity, thus enabling to reduce the combustion rate, which in turn achieves a reduction in the combustion noise. That is, conventionally the fuel injection was controlled by regulating solely the fuel injection quantity with the fuel injection rate kept constant, which caused a shortened injection period in idling, with a resulting explosive combustion lasting for a very short time within the cylinders of the engine which led to an increase in the combustion noise. The present invention can thus avoid such conventional drawback.

When the engine speed has further increased until the resulting increased pressure within the chamber 38 forces the piston 37 to be displaced rightward of the illustrated position, the annular groove 51 again comes to be obturated by the inner periphery of the cylinder bore 36 whereas the other annular groove 52 still communicates with the communication channel 48, as previously noted. That is, in the middle and high engine speed ranges, flowing of fuel out of the pump working chamber 11 through the communication channel 47 is thus interrupted so that the working chamber 11 is kept under ordinary or usual pressure. Although, as in idling, also in these middle and high speed ranges, the beginning of fuel injection during the pressure stroke of the plunger 7 takes place with a time lag corresponding to the prestroke with respect to the stroke position of the plunger 7 as compared with the engine starting, the actual fuel injection into the engine cylinders is advanced with respect to the position of the piston within the combustion chamber in compensation for an increase in the engine speed by means of a conventional timing control device, not shown, which may be installed in the fuel injection pump.

Under said arrangement, provided that the injection quantity and the amount of injection advance for an idling operation are set so as to satisfy the respective appropriate values, the fuel injection quantity is increased by an amount corresponding to the prestroke during starting of the engine as compared with that obtained by a conventional fuel injection pump, thus resulting in an improved starting characteristic of the engine. At the same time, the fuel injection is carried out with a time advance by an amount corresponding to the prestroke Sp, which results in elimination of ignition lag within the engine cylinders which often occured during starting of the engine and is attributed to cooling of the engine such as in cold weather, thus further improving the starting characteristics of the engine. In addition, according to the invention, since as previously mentioned, the fuel injection rate is decreased during idling of the engine which leads to a longer injection period, the combustion noise can be reduced. Still further, in a higher engine speed operation, fuel injection can be performed under ordinary or usual injection pressure and with an ordinary or usual injection advance characteristic by means of a conventional timing control device separately provided in the fuel injection pump.

It is to be understood that the foregoing description relates to preferred embodiments of the invention and that various changes and modifications may be made in the invention without departing from the spirit and scope thereof.

What is claimed is:

1. A fuel injection pump for an internal combustion engine, which comprises: a housing; a suction chamber defined within said housing; a barrel mounted within said housing; a plunger mounted within said barrel for axial and rotary motion therein; a pump working chamber defined by the housing, the barrel and the plunger; outlet pressure lines for connecting said pump working chamber with associated injection nozzles; a first relief channel including a port having one end thereof communicating with said pump working chamber and the other end terminating in an outer periphery of said plunger and a communication channel having one end thereof terminating in an inner periphery of said barrel and the other end arranged for communication with a zone under a lower pressure; a second relief channel allowing fuel to flow therethrough at a restricted rate and having one end thereof opening in said pump working chamber and the other end arranged for communication with a zone under a lower pressure; a valve means provided across said first and second relief channels; and a valve actuating means arranged in communication with a pressure source supplying a pressure varying with engine r.p.m.; wherein said port and communication channel of said first relief channel are so disposed as to communicate with each other at the beginning of fuel delivery stroke of said plunger, and said valve means is arranged to be actuated by said valve actuating means responsive to a varying pressure from said pressure source for blocking both said first and second relief channels during starting of the engine, opening both of them in a predetermined low engine speed range, and opening solely said first relief channel in a higher engine speed.

2. A fuel injection pump as recited in claim 1, in which said port of said first relief channel axially extends in said plunger from an end surface thereof facing said pump working chamber to communicate with a fuel injection quantity setting port radially opening in an outer periphery of a bottom end of the plunger.

3. A fuel injection pump as recited in claim 1, in which said port of said first relief channel terminates in an outer periphery of said plunger through an annular groove formed therein, said annular groove being so located as to overlap said communication channel of said first relief channel over a predetermined length when the plunger is at a bottom dead point thereof.

4. A fuel injection pump as recited in claim 1, in which said valve means comprises: a bore formed within said housing in communication on one side with said first and second relief channels and on the other side with at least one zone under a lower pressure; a piston slidably mounted within said bore; and a spring arranged for urging said piston in an axial direction of the bore against the force of said valve actuating means; wherein said piston has first and second passages extending therethrough to communicate with at least one zone under a lower pressure and so disposed as to communicate respectively with said first and second relief channels.

5. A fuel injection pump as recited in claim 4, in which said second passage has a portion thereof formed as a restriction passage.

6. A fuel injection pump as recited in claim 4, in which said first and second passages communicate respectively with the suction chamber within the pump housing and the suction side of an associated fuel pump.

7. A fuel injection pump as recited in claim 4, in which said first and second passages terminate in an outer periphery of the piston through respective annular grooves with different widths, the widths and locations of said annular grooves being such that as the piston is displaced by said valve actuating means, neither of said first and second passages registers with said first and second relief channels during starting of the engine, both of them register with said relief channels in a predetermined low engine speed range, and only said first passage communicates with said first relief channel in a higher engine speed range.

8. A fuel injection pump as recited in claim 4, in which said valve actuating means comprises a passage means having one end thereof communicating with one end of said bore and the other end with said pressure source supplying a pressure varying with engine r.p.m.

9. A fuel injection pump as recited in claim 8, in which said passage means comprises a supply line formed within said housing with one end thereof communicating with said suction chamber which is supplied with a fuel supply pressure by a fuel pump arranged for rotation at a speed proportional to engine r.p.m. and the other end disposed for communication with said pump working chamber, and an annular groove formed in an outer periphery of said barrel with one side thereof intersecting with said supply line and the other side communicating with said bore.

* * * * *